US008393701B2

(12) United States Patent
Govyadinov et al.

(10) Patent No.: US 8,393,701 B2
(45) Date of Patent: Mar. 12, 2013

(54) USING LIGHT-SCATTERING DROP DETECTOR TO DETERMINE TURN-ON-ENERGY FOR FLUID-EJECTION NOZZLE

(75) Inventors: Alexander Govyadinov, Corvallis, OR (US); Anton N. Clarkson, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 235 days.

(21) Appl. No.: 12/916,516

(22) Filed: Oct. 30, 2010

(65) Prior Publication Data

US 2012/0105526 A1 May 3, 2012

(51) Int. Cl.
*B41J 29/38* (2006.01)

(52) U.S. Cl. ..... 347/10; 347/9; 347/19

(58) Field of Classification Search ..... 347/9–10, 347/14, 19

See application file for complete search history.

(56) References Cited

U.S. PATENT DOCUMENTS

| | | | |
|---|---|---|---|
| 6,977,372 | B2 | 12/2005 | Valaskovic et al. |
| 7,233,015 | B2 | 6/2007 | Roberts |
| 7,483,767 | B2 | 1/2009 | Montaser et al. |
| 2006/0111807 | A1 | 5/2006 | Gothait et al. |
| 2006/0139392 | A1 | 6/2006 | Fernandez et al. |
| 2009/0189933 | A1 | 7/2009 | Nakano |
| 2009/0244141 | A1 | 10/2009 | Govyadinov et al. |
| 2009/0244163 | A1 | 10/2009 | Govyadinov |

FOREIGN PATENT DOCUMENTS

| | | | |
|---|---|---|---|
| JP | 2005083769 | A | 3/2005 |
| WO | 2010014061 | A1 | 2/2010 |

*Primary Examiner* — Juanita D Jackson

(57) ABSTRACT

For each energy value of a number of energy values, the energy value is applied to cause a fluid-ejection nozzle to eject a fluid drop. After the energy value has been applied to the fluid-ejection nozzle, a velocity of the fluid drop is determined using a light-scattering drop detector of the fluid-ejection device. A turn-on-energy (TOE) for the fluid-ejection nozzle is determined based on at least the velocities of the fluid drops determined after applying the energy values to the fluid-ejection nozzle.

15 Claims, 6 Drawing Sheets

USING LIGHT-SCATTERING DROP DETECTOR TO DETERMINE TURN-ON-ENERGY FOR FLUID-EJECTION NOZZLE

BACKGROUND

Fluid-ejection devices eject fluid onto media. For example, one type of fluid-ejection device is an inkjet-printing device, which ejects ink onto media like paper to form an image on the media. A fluid-ejection device typically includes a number of fluid-ejection nozzles, each of which can eject fluid. For some types of fluid-ejection devices, such as thermal fluid-ejection devices, energy is applied to cause a fluid-ejection nozzle to eject fluid.

DETAILED DESCRIPTION

As noted in the background section, for some types of fluid-ejection devices, energy is applied to cause a fluid-ejection nozzle to eject fluid. For instance, for thermal fluid-ejection devices, a fluid-ejection nozzle is associated with a heating resistor. Applying sufficient energy to the heating resistor causes the fluid to be ejected from the fluid-ejection nozzle.

An optimal energy at which a fluid-ejection nozzle ejects fluid is referred to as a turn-on energy (TOE) for the nozzle. The TOE is sufficiently large to cause the fluid-ejection nozzle to eject a fluid drop. However, the TOE is not so large as to cause fluid aerosol. Fluid aerosol can result when the fluid drop breaks up after ejection, for instance. Such fluid aerosol can impair the quality of the image resulting from such fluid ejection, in the case of an inkjet-printing device.

The TOE for a fluid-ejection nozzle is typically not static, and can increase over time. For instance, for thermal-fluid ejection devices, the heating resistor may degrade over time, resulting in a different voltage, current, or other type of electrical waveform to be applied to compensate for such changes, in order to cause a fluid-ejection nozzle to eject fluid. Furthermore, within the same fluid-ejection device, different fluid-ejection nozzles can have different TOE's, even when the fluid-ejection device is first manufactured.

Disclosed herein are approaches for determining the TOE for a fluid-ejection nozzle of a fluid-ejection device. These approaches use a light-scattering drop detector of the fluid-ejection device. Many types of fluid-ejection devices already include light-scattering drop detectors for other purposes, such as to ensure that the fluid-ejection nozzles are properly ejecting fluid, and during service of the fluid-ejection nozzles.

As one example, a number of different energy values may be applied to cause a fluid-ejection nozzle of a fluid-ejection device to eject fluid drops. The velocity of each fluid drop is determined using a light-scattering drop detector of the fluid-ejection device. The TOE for the fluid-ejection nozzle is determined based on at least the velocities of the fluid drops.

As another example, fluid aerosol associated with each fluid drop may be detected using the light-scattering drop detector of the fluid-ejection device. The TOE for the fluid-ejection nozzle may be determined further based on this fluid aerosol. As such, in this example, the TOE for the fluid-ejection nozzle is determined based on the velocities of the drops, and based on the fluid aerosol.

Figure 1:
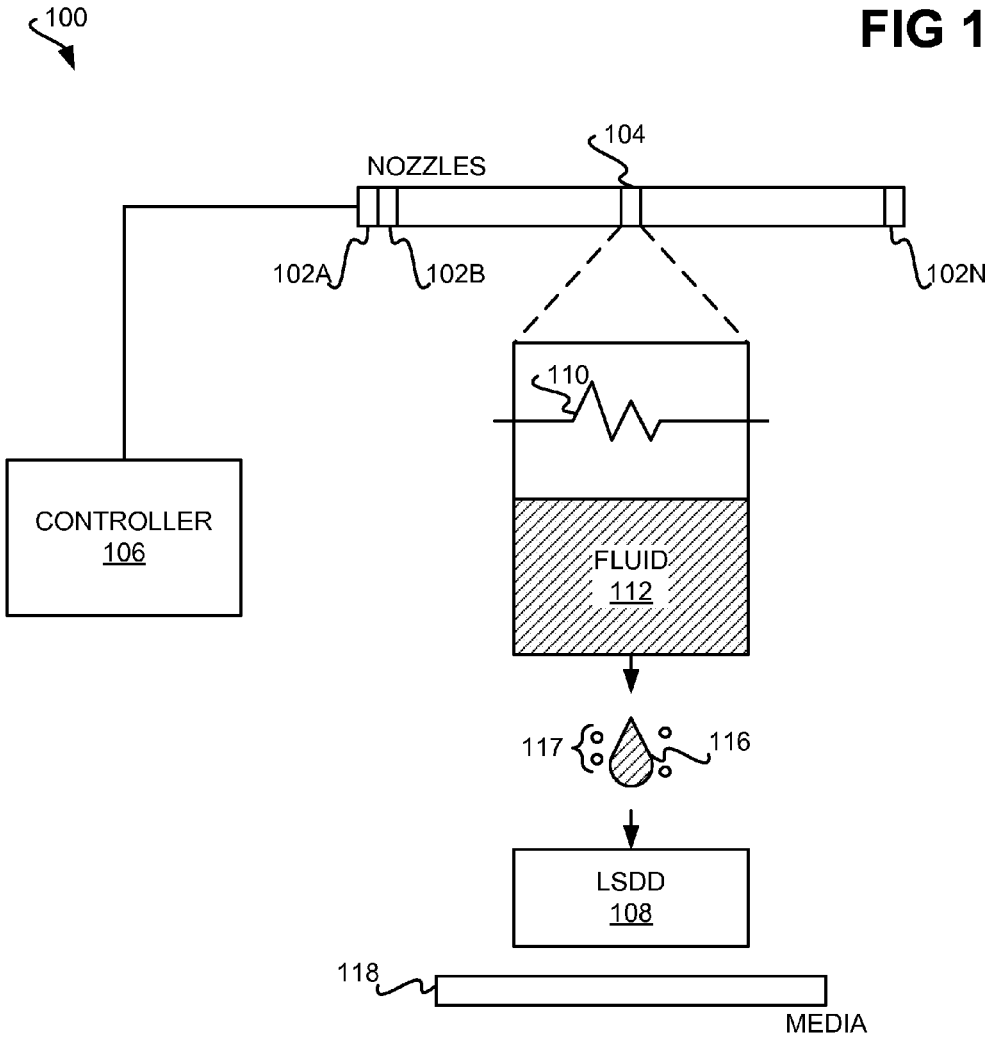
FIG. 1 is a diagram of a fluid-ejection device including a light-scattering drop detector, according to an example of the disclosure.

FIG. 1 shows a fluid-ejection device 100, according to an example of the disclosure. The fluid-ejection device 100 includes fluid-ejection nozzles 102A, 102B, . . . , 102N, collectively referred to as the fluid-ejection nozzles 102, and which include a representative fluid-ejection nozzle 104. The fluid-ejection device 100 further includes a controller 106 and a light-scattering drop detector 108. The fluid-ejection device 100 typically includes other components as well.

The fluid-ejection device 100 may be a scanning fluid-ejection device or a page-wide array fluid-ejection device. In a scanning fluid-ejection device, the fluid-ejection nozzles 102 are disposed on one or more movable fluid-ejection printheads. Media 118, such as paper, is moved on a swath-by-swath basis past the fluid-ejection printheads. For each swath, the fluid-ejection printheads are moved across the swath perpendicular to the direction in which the media 118 is advanced to eject fluid onto the swath in accordance with a predetermined pattern.

In a page-wide array fluid-ejection device, the fluid-ejection nozzles 102 are disposed on one or more stationary fluid-ejection printheads. The fluid-ejection printheads are organized in an array along a width of the media 118. The media 118 is moved past the fluid-ejection printheads in a direction perpendicular to the width of the media 118. As the media 118 is moved past the fluid-ejection printheads, the printheads eject fluid onto the media 118 in accordance with a predetermined pattern.

In the example of FIG. 1, the fluid-ejection device is a thermal fluid-ejection device. As such, the representative fluid-ejection nozzle 104 is said to include or be associated with a heating resistor 110. Applying energy to the heating resistor 110 causes the fluid 112 to be ejected through as a fluid drop 116, such as through an orifice of the nozzle 104. Fluid aerosol 117 may also result, either by being ejected from the nozzle 104, or due to the fluid drop 116 breaking up during flight. The fluid aerosol 117 is undesirable, and has a size much smaller than the size of the fluid drop 116 itself. The fluid drop 116, as well as the fluid aerosol 117 if present, passes through the light-scattering drop detector 108 and lands on the media 118.

The controller 106 is implemented at least in hardware. For instance, the controller 106 may be implemented as a computer program stored on a non-transitory computer-readable data storage medium of the fluid-ejection device 100, and which is executed by a processor of the device 100. Both the processor and the computer-readable data storage medium are considered hardware of the fluid-ejection device 100. As another example, the controller 106 may be implemented as a field-programmable gate array (FPGA), an application-specific integrated circuit (ASIC), or in another manner that involves at least hardware.

The controller 106 controls the movement of the media 118, and the ejection of fluid by the fluid-ejection nozzles 102 in accordance with a desired pattern, such as to form a desired image on the media 118. For instance, the controller 106 causes energy to be applied to the heating resistor 110 at a desired time to cause the fluid-ejection nozzle 104 to eject the fluid 112. The controller 106 further determines the TOE for each fluid-ejection nozzle 102, as is described in detail later in the detailed description. The controller 106 can individually and independently determine the TOE for each fluid-ejection nozzle 102.

Figure 2A:
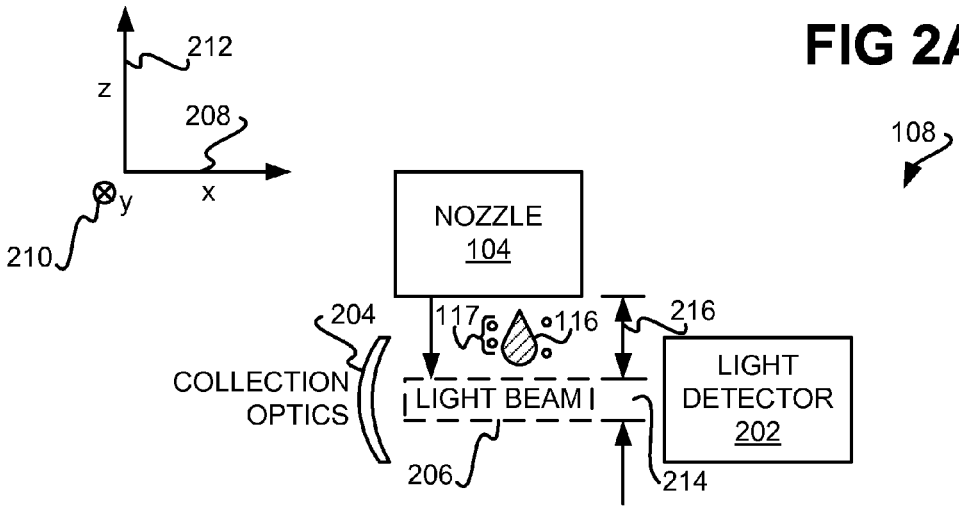
FIGS. 2A and 2B are cross-sectional diagrams of a light-scattering drop detector of a fluid-ejection device, according to an example of the disclosure.
Figure 2B:
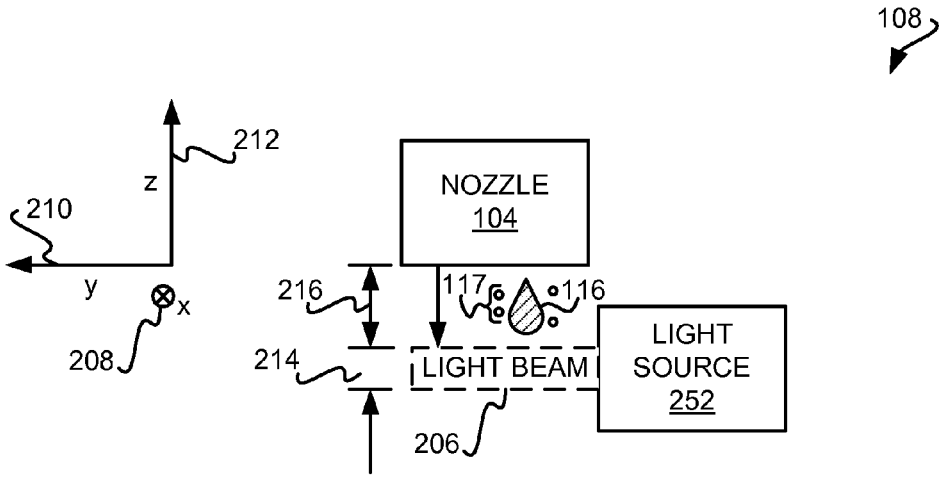

FIGS. 2A and 2B show the light-scattering drop detector 108 in detail, according to an example of the invention. Both FIGS. 2A and 2B are cross-sectional diagrams. An x-axis 208, a y-axis 210, and a z-axis 212 are depicted in both FIGS. 2A and 2B to illustrate the relationship between the cross-section of the light-scattering drop detector 108 in FIG. 2A and the cross-section of the drop detector 108 in FIG. 2B.

The light-scattering drop detector 108 includes a light detector 202, collection optics 204, and a light source 252 in the example of FIGS. 2A and 2B. The light source 252 emits a light beam 206. The light source 252 may be a laser, for instance, or a light-emitting diode (LED). The light beam 206 has a known width 214 where the fluid drop 116 and the fluid aerosol 117 ejected by the fluid-ejection nozzle 104 cross the light beam 206. Furthermore, the fluid-ejection nozzle 104 is located at a known distance 216 away from the light beam 206. That is, the distance 216 is the distance between where the fluid drop 116 is ejected by the fluid-ejection nozzle 104 and where the fluid drop 116 first enters the light beam 206.

The collection optics 204 may be a curved mirror, or another type of collection optics. The collection optics 204 serve to direct light reflected by the fluid drop 116 towards the light detector 202. The light detector 202 may be a photodiode, or another type of light detector. The light detector 202 detects the light scattered, or reflected, by the fluid drop 116 and the fluid aerosol 117 as the drop 116 and the aerosol 117 pass through the light beam 206 emitted by the light source 252. Such light can include light scattered directly from the fluid drop 116 and the fluid aerosol 117 to the light detector 202, as well as light scattered from the drop 116 and the aerosol 117 to the collection optics 204, which then directs this light to the detector 202.

In operation, the light source 252 emits the light beam 206. The fluid-ejection nozzle 104 ejects a fluid drop 116, and potentially fluid aerosol 117 also occurs. The fluid drop 116 and the fluid aerosol 117 pass through the light beam 206, reflecting this light. The light reflected by the fluid drop 116 and the fluid aerosol 117 is detected by the light detector 202. The collection optics 204 increases the amount of light reflected by the fluid drop 116 and the fluid aerosol 117 that is detected by the light detector 202.

Figure 2C:
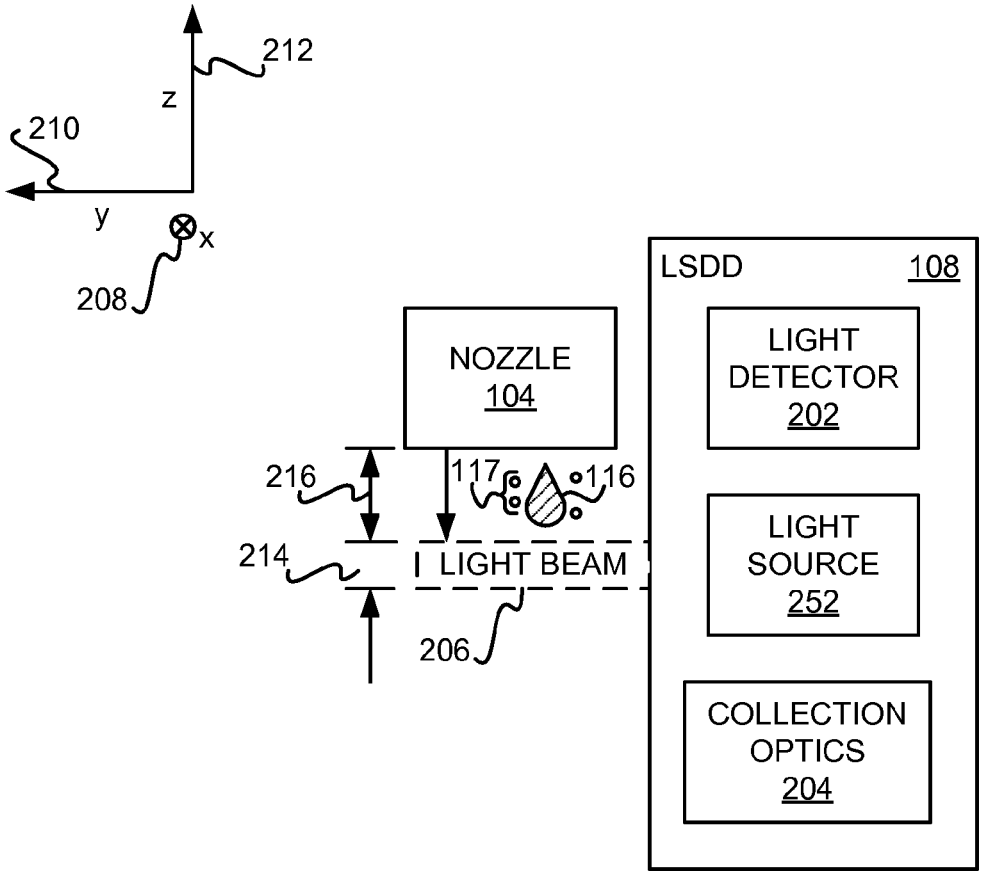
FIG. 2C is a cross-sectional diagram of a light-scattering drop detector of a fluid-ejection device, according to another example of the disclosure.

FIG. 2C shows the light-scattering drop detector 108, according to a different example of the disclosure. The x-axis 208, the y-axis 210, and the z-axis 212 are again depicted in FIG. 2C. In FIG. 2C, the light detector 202, the light source 252, and the collection optics 204 (where present) are all located on the same side to the fluid-ejection nozzle 104, as a unit. The fluid-ejection nozzle 104 again ejects the fluid drop 116, and potentially the fluid aerosol 117, which crosses the light beam 206 output by the light-scattering drop detector 108. As in FIGS. 2A and 2B, the light beam 206 has a known width 214, and the fluid-ejection nozzle 104 is located at a known distance 117 from the light beam 206.

Figure 3A:
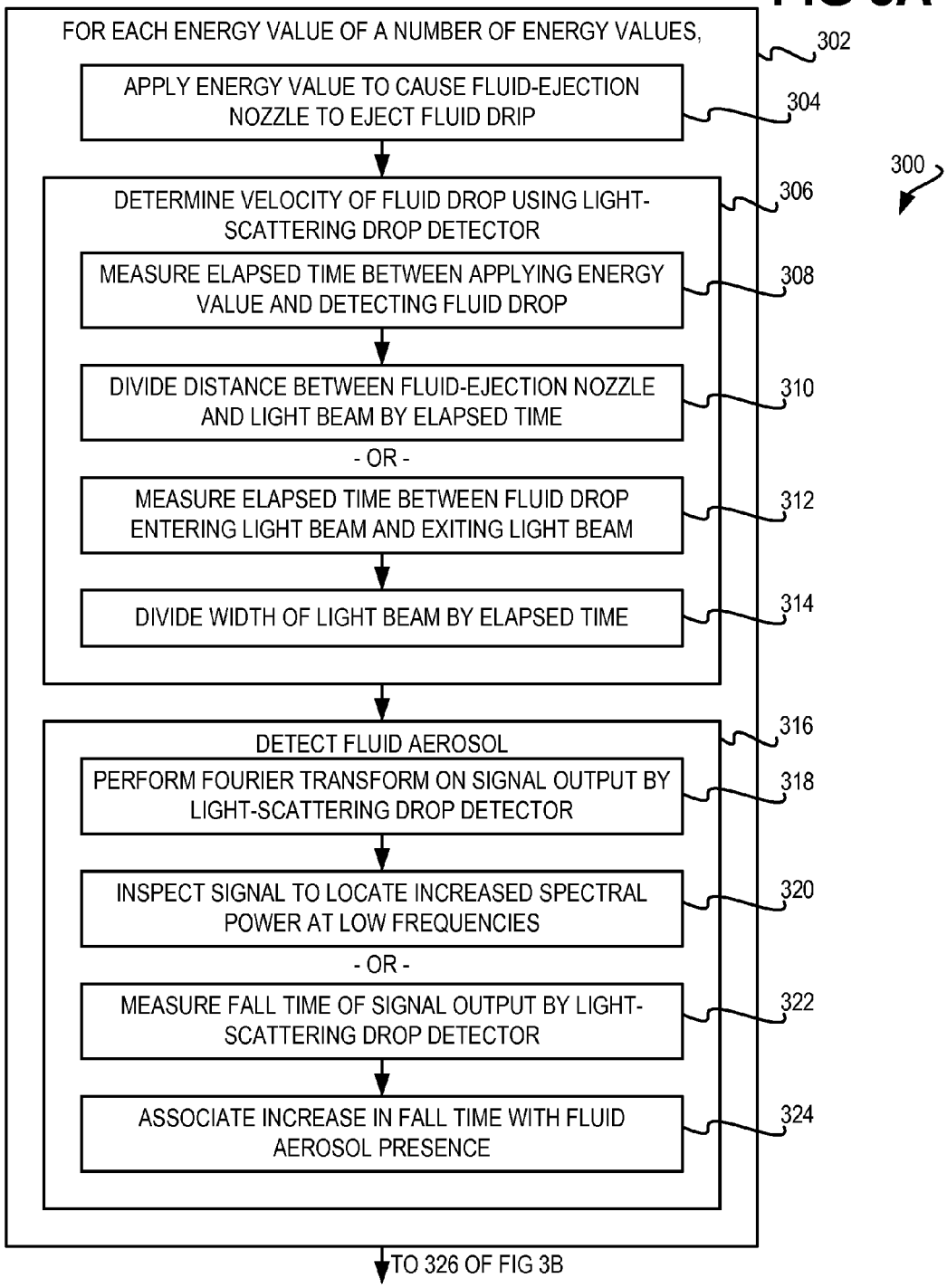
FIGS. 3A and 3B are flowcharts of a method to determine a turn-on energy (TOE) for a fluid-ejection nozzle of a fluid-ejection device using a light-scattering drop detector of the fluid-ejection device, according to an example of the disclosure.
Figure 3B:
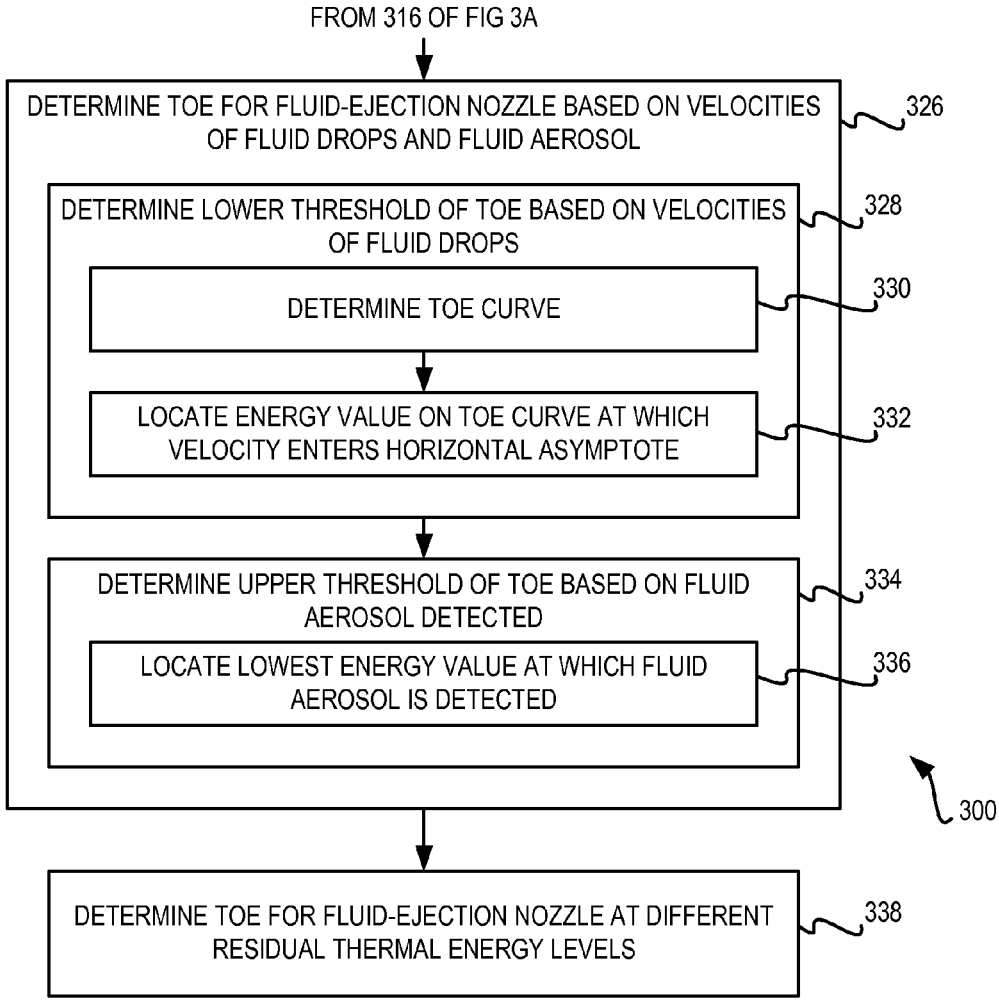

FIGS. 3A and 3B show a method 300 for determining the TOE of the fluid-ejection nozzle 104, according to an example of the disclosure. The method 300 may be implemented as one or more computer programs stored on a non-transitory computer-readable data storage medium for execution by the fluid-ejection device 100. For instance, the controller 106 may perform the method 300.

The following is performed for each energy value of a number of energy values, from a lowest energy value to a highest energy value (302). The energy value is applied to cause the fluid-ejection nozzle 104 to eject a fluid drop 116, and potentially fluid aerosol 117 as well (304). For instance, the controller 106 may cause an amount of energy equal to the current energy value to be applied to the heating resistor 110. Energy can be applied to the heating resistor 110 by varying the voltage over the heating resistor 110, and/or the length of time at which this voltage is applied, over one or more pulses.

The velocity of the fluid drop 116 is determined using the light-scattering drop detector 108 (306). Two different approaches for determining the velocity of the fluid drop 116 using the light-scattering drop detector 108 are described herein. First, the elapsed time between when the energy value is applied and when the fluid drop 116 is detected by the light-scattering drop detector 108 can be measured (308). For instance, if the energy value is applied at time t0, and the fluid drop 116 is detected at time t1, then the elapsed time is equal to t1 minus t0. The distance 216 between the fluid-ejection nozzle 104 and the light beam 206 is then divided by this elapsed time to calculate the velocity of the fluid drop 116 (310).

Second, the elapsed time between when the fluid drop 116 first enters the light beam 206 emitted by the light-scattering drop detector 108 and when the fluid drop 116 has finished exiting the light beam 206 is measured (312). When the fluid drop 116 first enters the light beam 206 is detected by the light-scattering drop detector 108 first detecting light reflected by the fluid drop 116. When the fluid drop 116 last exits the light beam 206 is detected by the drop detector 108 no longer detecting light reflected by the fluid drop 116. The width 214 of the light beam 206 is then divided by this elapsed time to calculate the velocity of the fluid drop 116 (314). It is noted that the fluid drop 116 is in actuality orders of magnitude smaller in size than the width of the light beam 106, which is why determining the velocity of the fluid drop 116 in this manner is accurate.

Whether fluid aerosol 117 results from applying the energy value in part 304 can also be detected (316). As noted above, the fluid aerosol 117 can be ejected by the fluid-ejection nozzle 104, or the fluid aerosol 117 can result from the fluid drop 116 breaking up during flight. Two different approaches for detecting the fluid aerosol 117 using the light-scattering drop detector 108 are described herein.

First, a Fourier transform, or another type of spectral analysis technique, can be performed on the signal output by the light-scattering drop detector 108 (318). The spectral analysis technique that is performed can be a discrete Fourier transform (DFT), a discrete cosine transform (DCT), or a real-time fast Fourier transform (FFT), for instance. The transformed version of the signal is inspected to locate increased spectral power at low frequencies (320). If such increased spectral power is present, fluid aerosol 117 exists.

This approach accurately detects the fluid aerosol 117 because the aerosol 117 travels at lower rates of speed than the fluid drop 116 itself does. As such, by taking a Fourier transform of the signal output by the light-scattering drop detector 108 (or another spectral analysis technique), the various speeds of the fluid 112 ejected by the fluid-ejection nozzle 104, in the form of the fluid drop 116 and the fluid aerosol 117, can be inspected. Low frequency components of the signal, such as components having frequencies below a first threshold, that have increased spectral magnitudes, such as magnitudes above a second threshold, correspond to the presence of fluid aerosol 117. That is, a spectral analysis technique results in a number of values, or magnitudes, for a number of frequencies. It has been found that where the values or magnitudes for frequencies less than a first threshold (i.e., low frequencies) are greater than a second threshold, then fluid aerosol 117 has occurred.

Second, the fall time of the signal output by the light-scattering drop detector 108 can be measured (322). The fall time of the signal is the length of time between when the light-scattering drop detector 108 reaches a peak amplitude caused by light reflected by the fluid drop 116 and/or the fluid aerosol 117 and when the drop detector 108 no longer detects such light. An increase in the fall time is associated with the presence of the fluid aerosol 117 (324).

This approach accurately detects the fluid aerosol 117 because again the aerosol 117 travels at lower rates of speed than the fluid drop 116 itself does. If no fluid aerosol 117 is present, then the fall time will be relatively low. If fluid aerosol 117 is present, then the fall time will increase. For example, if the fall time at a current energy value minus the fall time at the first or a prior energy value is greater than a given threshold, then it can be concluded that there has been an increase in fall time associated with the presence of fluid aerosol 117. As another example, if the fall time is itself greater than a given threshold, then it can be concluded that the fall time has sufficiently increased such that the fall time is associated with the presence of fluid aerosol 117.

Once parts 304, 306, and 316 have been performed for each energy value, the TOE for the fluid-ejection nozzle 104 is determined based on the velocities of the fluid drops 116 that have been determined, and/or based on the detection of the fluid aerosol 117 (326). This can be accomplished as follows.

The lower threshold of the TOE is determined based on the velocities of the fluid drops 116 (328). In particular, a TOE curve is determined, and the energy value on the TOE curve at which velocity enters a horizontal asymptote of the curve is located as the lower threshold (330).

The TOE curve is a curve that indicates fluid drop velocity as a function of the energy value. At lower energy values, no fluid drops 116 are ejected from the fluid-ejection nozzle 104, effectively yielding zero fluid drop velocity. As the energy value increases, the fluid drop 116 is ejected from the fluid-ejection nozzle 104 at increasing velocity, until at some point fluid drop velocity remains substantially constant regardless of the energy value. The point at which the TOE curve plateaus in this manner is where the fluid drop velocity enters a horizontal asymptote of the curve.

The upper threshold of the TOE is determined based on the fluid aerosol 117 detected (334). In particular, the lowest energy value at which fluid aerosol 117 has been detected is the upper threshold (336). At lower energy values, typically no fluid aerosol 117 will be detected. However, once the energy value increases past which there is no further increase in fluid drop velocity, the extra energy applied may cause the fluid drop 116 to begin to break apart, resulting in fluid aerosol 117. The energy value at which fluid aerosol 117 begins to occur (and thus is detected) is the upper threshold of the TOE.

The TOE for the fluid-ejection nozzle 104 can therefore be set between the lower and upper thresholds with the confidence that the nozzle 104 will reliably eject fluid drops 116 without resulting in fluid aerosol 117 occurring. As the fluid-ejection nozzle 104 ages, the method 300 may be reperformed to redetermine the TOE. As noted above, for instance, the heating resistor 110 can degrade over time, resulting in a higher TOE for the fluid-ejection nozzle 104 over time. Furthermore, as also noted above, the TOE for each fluid-ejection nozzle 102 of the fluid-ejection device 100 may be independently and individually determined, such as via the method 300.

Furthermore, the TOE for the fluid-ejection nozzle 104 can be determined at different residual thermal energy levels (338), using the approach that has been described thus far for determining the TOE for the nozzle 104. After a fluid-ejection nozzle 104 fires, the nozzle 104 may retain thermal energy that dissipates over time. Therefore, the TOE, as well as the energy at which fluid aerosol occurs, for the fluid-ejection nozzle 104 can be determined at different temperature levels dependent on the different periods of time have elapsed since the last time the nozzle 104 ejected a fluid drop 116 and since the previous duty cycle of the nozzle 104. These different TOE's are then recorded, along with a temperature measurement. When it comes time to fire the fluid-ejection nozzle 104, the appropriate TOE is then used, based on the length of time that has elapsed since the last time the nozzle 104 was used to eject a fluid drop 116, or based on the current temperature of the nozzle 104. In general, it is expected that the shorter the time that has elapsed since the last time the fluid-ejection nozzle 104 was used to eject a fluid drop 116, the lower the TOE for the nozzle 104 to eject another fluid drop 116 without fluid aerosol occurring.

Figure 4:
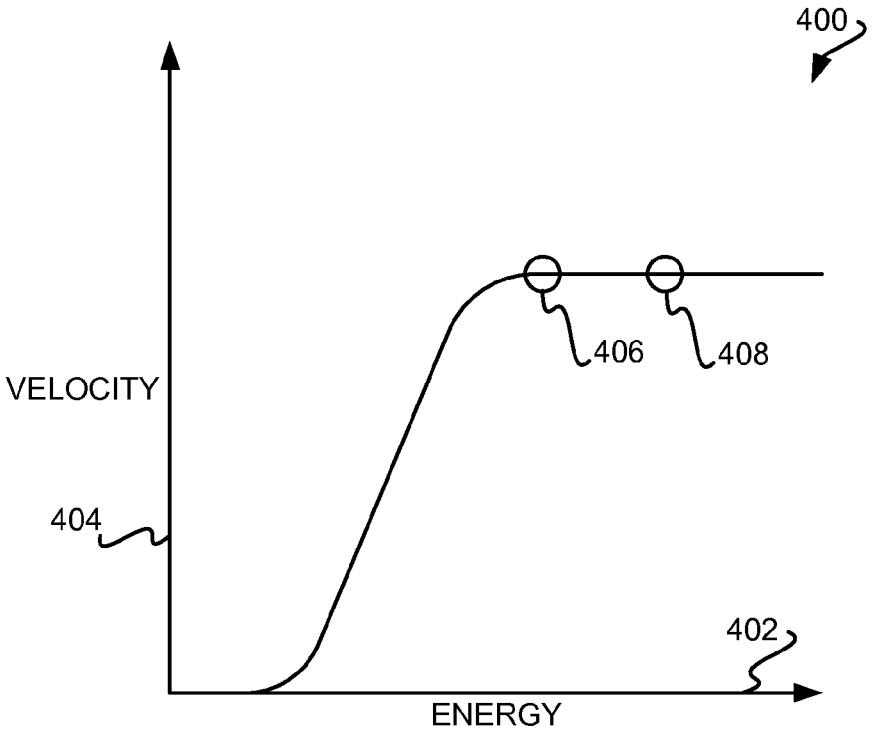
FIG. 4 is a graph of a representative TOE curve, according to an example of the disclosure.

FIG. 4 shows a representative TOE curve 400, according to an example of the disclosure. The x-axis 402 indicates applied energy, and the y-axis 404 indicates fluid drop velocity. At the point 406, the TOE curve 400 enters a horizontal asymptote, and begins to plateau. The energy at the point 406 thus corresponds to the lower TOE threshold. At the point 408, fluid aerosol 117 may have begun to be detected. The energy at the point 408 thus corresponds to the upper TOE threshold.

Variations in how the TOE for the fluid-ejection nozzle 104 can be determined are also encompassed by the present disclosure. As one example, just the fluid drop velocity may be determined in part 306 for each energy value, such that the fluid aerosol 117 is not detected in part 316 for each energy value. In this example, the point on the TOE curve 400 at which the curve 400 enters a horizontal asymptote may be set as the TOE for the fluid-ejection nozzle 104, such that there is no lower threshold, and such that there is no upper threshold determined per nozzle.

The disclosed approaches for determining fluid-ejection nozzle TOE are advantageous, at least because they may not require any additional hardware to be added to a fluid-ejection device. As noted above, a fluid-ejection device may already have a light-scattering drop detector for fluid-ejection servicing as well as other purposes. As such, the disclosed approaches can leverage such an existing light-scattering drop detector to also determine the TOE for a fluid-ejection nozzle. Therefore, the approaches disclosed herein are a lower cost way to determine fluid-ejection nozzle TOE, since no additional hardware may have to be added to a given fluid-ejection device to use these approaches.

It is finally noted that the fluid-ejection device 100 that has been described may be an inkjet-printing device, which is a device, such as a printer, that ejects ink onto media, such as paper, to form images, which can include text, on the media. The fluid-ejection device 100 is more generally a fluid-ejection, precision-dispensing device that precisely dispenses fluid, such as ink, melted wax, or polymers. The fluid-ejection device 100 may eject pigment-based ink, dye-based ink, another type of ink, or another type of fluid. Examples of other types of fluid include those having water-based or aqueous solvents, as well as those having non-water-based or non-aqueous solvents. However, any type of fluid-ejection, precision-dispensing device that dispenses a substantially liquid fluid may be used.

A fluid-ejection precision-dispensing device is therefore a drop-on-demand device in which printing, or dispensing, of the substantially liquid fluid in question is achieved by precisely printing or dispensing in accurately specified locations, with or without making a particular image on that which is being printed or dispensed on. The fluid ejection device may use any inkjet dispensing technology, such as thermal inkjet technology, piezo-inkjet technology, continuous inkjet technology, and so on. As such, the approach for determining TOE and the energy at which fluid aerosol occurs that has been described can be used in conjunction with any of these and other types of inkjet and other fluid-ejection devices. A fluid-ejection precision-dispensing device precisely prints or dispenses a substantially liquid fluid in that the latter is not substantially or primarily composed of gases such as air. Examples of such substantially liquid fluids include inks in the case of inkjet-printing devices. Other examples of substantially liquid fluids thus include drugs, cellular products, organisms, fuel, and so on, which are not substantially or primarily composed of gases such as air and other types of gases, as can be appreciated by those of ordinary skill within the art.

We claim:

1. A method for determining a turn-on energy (TOE) for a fluid-ejection nozzle of a fluid-ejection device using a plurality of energy values corresponding to different amounts of energy that can be applied to the fluid-ejection nozzle to cause the fluid-ejection nozzle to eject a fluid drop, comprising:

for each energy value, applying the energy value to cause the fluid-ejection nozzle to eject the fluid drop;

after applying the energy value, determining a velocity of the fluid drop using a light-scattering drop detector; and, determining the TOE for the fluid-ejection nozzle based on at least the velocities of the fluid drops determined after applying the energy values.

2. The method of claim 1, wherein determining the velocity of the fluid drop using the light-scattering drop detector comprises:

measuring an elapsed time between applying the energy value and the light-scattering drop detector detecting the fluid drop; and, dividing a distance between the fluid-ejection nozzle and a light beam emitted by the light-scattering drop detector by the elapsed time measured.

3. The method of claim 1, wherein determining the velocity of the fluid drop using the light-scattering drop detector comprises:

measuring an elapsed time between the fluid drop entering a light beam of the light-scattering drop detector and the fluid drop exiting the light beam of the light-scattering drop detector; and, dividing a width of the light beam by the elapsed time measured.

4. The method of claim 1, wherein determining the TOE for the fluid-ejection nozzle based on at least the velocities of the fluid drops determined after applying the energy values comprises:

determining a TOE curve indicating the velocity of the fluid drop as a function of the energy value applied; and, locating the energy value on the TOE curve at which the velocity of the fluid drop enters a horizontal asymptote of the TOE curve.

5. The method of claim 1, further comprising, for each energy value of the plurality of energy values, after applying the energy value, detecting fluid aerosol associated with the fluid drop, using the light-scattering drop detector, wherein determining the TOE for the fluid-ejection nozzle is further based on the fluid aerosol detected after applying the energy values.

6. The method of claim 5, wherein detecting the fluid aerosol associated with the fluid drop, using the light-scattering drop detector, comprises:

performing a spectral analysis technique on a signal output by the light-scattering drop detector; and, after performing the spectral analysis technique on the signal, inspecting the signal to locate increased spectral power at low frequencies, wherein the fluid aerosol causes the increased spectral power at the low frequencies.

7. The method of claim 5, wherein detecting the fluid aerosol associated with the fluid drop, using the light-scattering drop detector, comprises:

measuring a fall time of a signal output by the light-scattering drop detector, the fall time corresponding to a length of time between when the light-scattering drop detector reaches a peak amplitude caused by light reflected by the fluid drop and/or the fluid aerosol ejected by the fluid-ejection nozzle and when the light-scattering drop detector no longer detects any fluid ejected by the fluid-ejection nozzle; and, associating an increase in the fall time of the signal with a presence of the fluid aerosol.

8. The method of claim 5, wherein determining the TOE for the fluid-ejection nozzle comprises:

determining a lower threshold of the TOE based on the velocities of the fluid drops determined after applying the energy values; and, determining an upper threshold of the TOE based on the fluid aerosol detected after applying the energy values.

9. The method of claim 8, wherein determining the upper threshold of the TOE comprises locating a lowest energy value at which the fluid aerosol is detected, and wherein determining the lower threshold of the TOE comprises:

determining a TOE curve indicating the velocity of the fluid drop as a function of the energy value applied; and, locating the energy value on the TOE curve at which the velocity of the fluid drop enters a horizontal asymptote of the TOE curve.

10. The method of claim 1, further comprising determining the TOE for the fluid-ejection nozzle at different residual thermal energy levels of the fluid-ejection nozzle.

11. A fluid-ejection device comprising:

a fluid-ejection nozzle to eject fluid, where a plurality of energy values correspond to different amounts of energy that can be applied to the fluid-ejection nozzle to cause the fluid-ejection nozzle to eject a fluid drop;

a light-scattering drop detector to assist determination of a velocity of the fluid drop ejected by the fluid-ejection nozzle for each energy value applied; and, a controller implemented at least in hardware to determine a turn-on energy (TOE) for the fluid-ejection nozzle based on at least the velocities of the fluid drops.

12. The fluid-ejection device of claim 11, wherein the light-scattering drop detector is further to detect fluid aerosol associated with the fluid drop ejected by the fluid-ejection nozzle for each energy value applied, wherein the controller is to determine the TOE for the fluid-ejection nozzle further based on the fluid aerosol detected.

13. The fluid-ejection device of claim 11, wherein the fluid-ejection device further comprises a plurality of other fluid-ejection nozzles, and wherein the controller is to individually determine a TOE for each other fluid-ejection nozzle based on velocities of fluid drops ejected by the other fluid-ejection nozzle for the plurality of energy values applied to the other fluid-ejection nozzle.

14. A non-transitory computer-readable data storage medium to store a computer program executable by a fluid-ejection device having a fluid-ejection nozzle and a light-scattering drop detector to cause performance of a method for determining a turn-on energy (TOE) for the fluid-ejection nozzle using a plurality of energy values corresponding to different amounts of energy that can be applied to the fluid-ejection nozzle to cause the fluid-ejection nozzle to eject a fluid drop, comprising:

for each energy value, applying the energy value to cause the fluid-ejection nozzle to eject the fluid drop;

after applying the energy value, determining a velocity of the fluid drop using the light-scattering drop detector; and, determining the TOE for the fluid-ejection nozzle based on at least the velocities of the fluid drops determined after applying the energy values.

15. The non-transitory computer-readable data storage medium of claim 14, wherein the method further comprises, for each energy value of the plurality of energy values, after applying the energy value, detecting fluid aerosol associated with the fluid drop, using the light-scattering drop detector, wherein determining the TOE for the fluid-ejection nozzle is further based on the fluid aerosol detected after applying the energy values.

* * * * *